US005505822A

United States Patent [19]

Martin et al.

[11] Patent Number: 5,505,822

[45] Date of Patent: Apr. 9, 1996

[54] PROCESS AND DEVICE FOR TREATING WASTE BY DIRECT CONTACT

[75] Inventors: Gérard Martin, Rueil Malmaison; Robert Gaulard, Sussy En Brie, both of France

[73] Assignee: Institut Francais du Petrole, Rueil Malmaison, France

[21] Appl. No.: 911,066

[22] Filed: Jul. 9, 1992

[30] Foreign Application Priority Data

Jul. 9, 1991 [FR] France ..... 91 08717

[51] Int. Cl.[6] ..... C10B 47/00; C10B 53/00

[52] U.S. Cl. ..... 201/25; 201/20; 201/27; 201/29; 202/99

[58] Field of Search ..... 201/20, 21, 25, 201/27, 29, 34, 37, 17; 202/99

[56] References Cited

U.S. PATENT DOCUMENTS

| | | | |
|---|---|---|---|
| 3,862,887 | 1/1975 | Bielski et al. | 201/25 |
| 3,962,045 | 6/1976 | Douglas et al. | 201/25 |
| 3,971,704 | 7/1976 | von Klenck et al. | 201/27 |
| 4,050,991 | 9/1977 | Kautz | 201/37 |
| 4,303,477 | 12/1981 | Schmidt et al. | 201/20 |
| 4,364,796 | 12/1982 | Ishii et al. | 201/29 |

FOREIGN PATENT DOCUMENTS

| | | | |
|---|---|---|---|
| 29580 | 6/1981 | European Pat. Off. | 201/25 |
| 0426925 | 5/1991 | European Pat. Off. . | |
| 2331752 | 6/1977 | France . | |
| 1935214 | 1/1971 | Germany | 201/27 |
| 3040227 | 5/1982 | Germany | 201/27 |
| 3509275 | 12/1985 | Germany . | |
| 3606144 | 7/1987 | Germany | 201/20 |
| 52-3644 | 1/1977 | Japan | 201/25 |
| 2106934 | 4/1983 | United Kingdom . | |

OTHER PUBLICATIONS

Translation of German Pat. No. 3606144 cited in paper No. 6.

*Primary Examiner*—David L. Lacey
*Assistant Examiner*—Calvin Padgett
*Attorney, Agent, or Firm*—Antonelli, Terry, Stout & Kraus

[57] ABSTRACT

A process for treating industrial and/or urban waste includes the steps of drying the waste; effecting thermolysis of the dried waste by direct contact with warm gases, and washing solids resulting from the thermolysis with water to effect dechlorination thereof. Thermolysis is effected by direct contact of the waste with warm gases having a low oxygen content and water for washing the solids is obtained from condensation of vapors generated during drying of the waste A plant for treating industrial and/or urban waste includes a drier for drying the waste, a reactor for thermolyzing the waste, washing the solids from the reactor with water, such as from a condenser, to dechlorinate the solids, and a gas generator to generate warm gases, of which a part of the warm gases are used to heat the drier.

12 Claims, 3 Drawing Sheets

1
2
3
4
5
6
7
8
9
10
11
12
13
14
15
16
17
18
19
20
21
22
23
24
25
251
252

PROCESS AND DEVICE FOR TREATING WASTE BY DIRECT CONTACT

BACKGROUND OF THE INVENTION

The present invention relates to the treatment of industrial and/or urban waste and more specifically to the thermolysis thereof.

Several implementations have already been proposed in the field of thermal treatment of waste.

Thus, the applicant has presented in patent application FR-A-2,668,774 a process and a plant comprising a waste thermolysis operation, followed by a hot and dry treatment of the effluents resulting from the pyrolysis. The purpose of this implementation is essentially to reduce, or even to remove most of the pollutants present in the pyrolysis effluents, which are usually discharged into the atmosphere.

In the same field, document DE-35, 09,275 discloses a process for treating urban waste according to which this waste is successively dried, heated and then cooled, and the gases resulting from the combustion may be treated and thereafter partly discharged into the atmosphere and partly recycled.

As for the treatment of the solids resulting from the thermolysis, the applicant has also disclosed a thermolysis treatment of the waste comprising a dechlorination stage by washing said solids.

This implementation has notably the advantage of producing a coke cleared of the most part of the pollutants, that is to say a coke which is easily re-usable, having an improved calorific power in relation to systems which do not treat the solid products resulting from the thermolysis.

The object of the present invention is to improve the thermolysis of industrial waste by proposing not only to achieve a dechlorination of the solids resulting from the thermolysis, but also to directly heat the waste, through contacting in the pyrolysis means, with warm heat-carrying gases.

The present invention offers the following advantages in relation to an implementing without contact, through external heating:

the thermolysis means is simplified in relation to the devices using an indirect heating since the external heating means disappear;

tightness problems are considerably reduced since tightness is limited to inlets and outlets of reduced section;

the power consumption of the process according to the invention is lower than with an indirect heating, because, according to the present invention, the gases come out at relatively low temperatures and no longer at the final thermolysis temperature. Besides, for the same degree of insulation, the heat losses of the thermolysis means are much lower;

the size of the thermolysis reactor (or means) is reduced on account of the waste occupying almost the total volume available;

the yield of the coke having an improved calorific power is increased through an almost complete decomposition of the tars. In fact, the tars circulate partly in closed circuit, which means that the tars produced in the warm zone migrate towards the cold zone in the gas phase, condense in said cold zone, then go back to the warm zone, carried along by the solids, where they undergo a new cracking and so forth, so that they finally disappear almost completely to the advantage of the coke and the incondensable gaseous fractions.

SUMMARY OF THE INVENTION

These advantages can be obtained according to the present invention whose object is a process for treating industrial and/or urban waste, notably comprising a drying stage, a waste thermolysis stage, and a dechlorination stage by washing the solids resulting from the thermolysis.

Said thermolysis is achieved by direct contact of the waste with warm gases having a low oxygen content.

The oxygen content of the warm gases used for the thermolysis is preferably lower than 10%, and preferably lower than 4% by volume.

The warm gases used for the thermolysis may consist essentially of recycled thermolysis gases.

The contact, which takes place in the thermolysis means, is advantageously a counterflow contact.

According to one embodiment of the invention, the warm gases used for the thermolysis essentially consist of effluents resulting from a fluidized bed combustion whose oxygen content is controlled.

Without departing from the scope of the invention, a fraction of the gases resulting from the thermolysis flow through a heat exchanger before being recycled as a heat-carrying gas.

Besides, the warm gases used for the drying stage come either from a specific generator, or from a heat exchanger fed with the gases coming from said specific generator.

The object of the invention is also a plant for treating industrial and/or urban waste comprising notably:

a means for the thermolysis of the waste, at least partly fed by the thermolysis effluents or by the warm gases resulting from the combustion of the thermolysis effluents, and having separate outlets for the thermolysis solids and effluents, a means for generating warm fumes, a means for collecting and washing the solid products from the thermolysis means.

According to the invention, the thermolysis means comprises at least one inlet for the waste and at least one inlet for warm gases, the waste and the warm gases being in direct contact in the thermolysis means.

The means for generating warm fumes may consist of a fluidized bed reactor.

The plant may also comprise at least one preheating exchanger located for example at the inlet of the thermolysis means.

The plant may further comprise a second heat exchanger, between the gases coming from the means generating warm fumes and the air supplying a drier.

BRIEF DESCRIPTION OF THE DRAWINGS

Other features and advantages of the invention will be clear from reading the description hereafter, given by way of non limitative example, with reference to the accompanying drawings in which.

DESCRIPTION OF THE PREFERRED EMBODIMENTS

Figure 1:
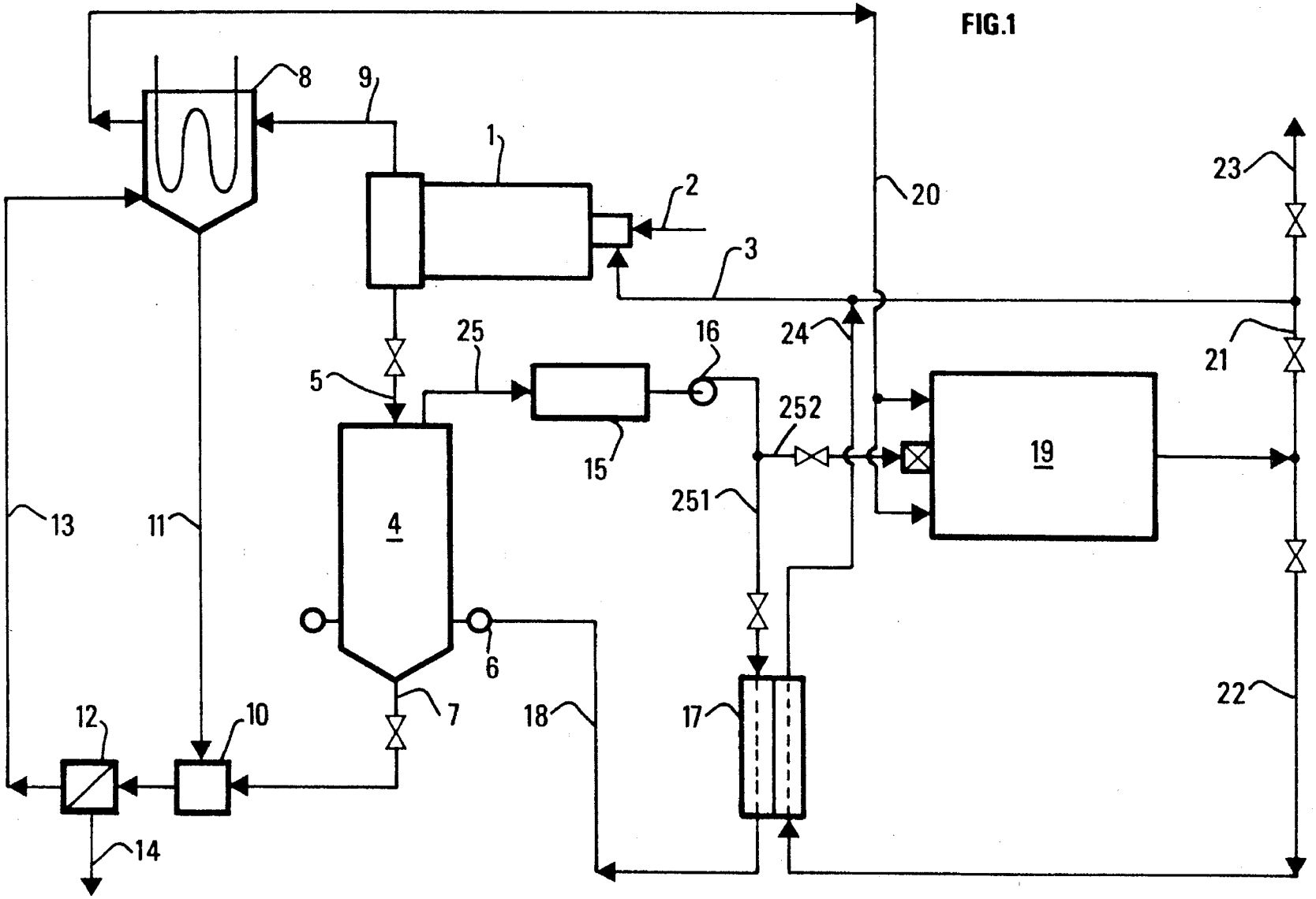
FIG. 1 is a diagram showing a first embodiment of the invention.

FIG. 1 diagrammatically shows a preferred embodiment of the invention, in which the plant essentially comprises a drying chamber 1 crossed through both by the waste to be treated (line 2) and by warm gases supplied through line 3.

The warm gases enter drier 1 at a temperature ranging between 200° and 1200° C., preferably between 400° and 800° C. They flow out through line 9, at a temperature ranging between 50° and 100° C.

The waste is thus dried through this input of heat in motion. Drier 1 preferably works with cocurrent flows (the waste and the warm gases flow in the same direction) so as to avoid the risks of inflammation of the waste.

The dried waste is transferred via line 5 towards the thermolysis reactor (or means) 4 which works, according to the invention, as a vertical moving bed.

In fact, the waste is introduced in the upper part of thermolysis reactor 4 and passes by gravity into the reactor having a substantially vertical axis. On the other hand, the warm gases are preferably introduced at the bottom (or close to the bottom) of reactor 4 through any device 6 known in itself. The warm gases percolate in an upward flow through the waste bed and progressively give up the energy thereof to the solids.

Thus, the temperature of the waste progressively increases as the waste migrates towards the bottom of reactor 4, and finally reaches the temperature of the warm gases before being introduced into reactor 4, that is a temperature ranging between 300° and 1000° C., preferably between 400° and 600° C.

The warm solids, essentially consisting of coke and mineral products, are carried away from reactor 4 through line 7 located below reactor 4. Reactor 4 therefore works as a counter-current moving bed (possibly as a fluidized bed in the place of the thermolyzer where the grain size is small).

The solids which have been subjected to the thermolysis operation in reactor 4 are thereafter cooled and washed in a specific enclosure 10.

The condensation water of the drying effluents, delivered through line 11, is preferably used for this operation. This condensation water may come from a condenser 8 supplied by the moist gases coming from drier 1 via a line 9.

A mixing between the solids from thermolysis reactor 4 and the above-cited wash waters is thus achieved in enclosure 10.

Mixing is intended to remove essentially the chlorides present in the solids coming from reactor 4.

The mixture is thereafter discharged towards a means 12 for separating the solids cleared of the chlorides from the wash water: the depolluted solids are extracted through line 14 while the wash water is extracted through a specific line 13.

The wash water is preferably filtered (filter not shown) before being fed back through line 13 towards condenser 8. This re-use of the wash waters is in no way obligatory. It is however useful, if only for the economy that is achieved.

After describing the treatment of the solids resulting from the thermolysis operation, the treatment of the gases coming from and flowing towards reactor 4 will now be described in connection with FIG. 1.

As has already been mentioned, the heating gases have a cocurrent circulation with respect to the waste, that is they circulate upwards in reactor 4. These heating gases are accompanied by gases generated by the thermolysis, so that the weight flow of outgoing gas is higher than the weight flow of incoming gas.

A fan 16 or any other means for setting the gaseous mixture in motion may be placed at the outlet of reheating means 15 so as to provide the circulating of said mixture. However, this stirring is not obligatory for the implementing of the invention.

According to this first embodiment of the invention, part of the thermolysis gases is then sent via a line 251 towards a gas-gas heat exchanger 17 so as to be reheated again, before entering reactor 4 via line 18. At the outlet of exchanger 17, the gases are commonly brought to a temperature ranging between 300° and 1000° C., preferably between 400° and 600° C.

The rate and the final temperature of the thermolysis gases recycled thereby can be permanently adjusted so as to compensate for the possible heat losses in thermolysis reactor 4, and to provide the energy necessary for the thermolysis.

The temperature of the gases at the level of line 18 is also set by taking into account the fouling problems which may appear if the gases crack within exchanger 17.

The other part of the thermolysis gases, reheated in means 15 and ventilated thereafter, can be sent into a specific generator 19. This generator 19 is thus used for burning said thermolysis gases.

Generator 19 is also used for incinerating possible traces of organic matter present in the drying effluents. The latter are delivered through one or several specific line(s) 20.

At the outlet of this generator 19, the temperature of the gases is about 800° to 1600° C.

Part of the gases coming from generator 19 is used for supplying drier 1 with warm gases via a line 21, then via line 3. The other part of these gases is sent via a line 22 towards the gas-gas exchanger 17.

These gases are thus used for preheating the recycled part of the thermolysis gases.

Downstream from exchanger 17, the warm gases can be sent back towards drier 1, a line 24 is then used therefore.

Figure 2:
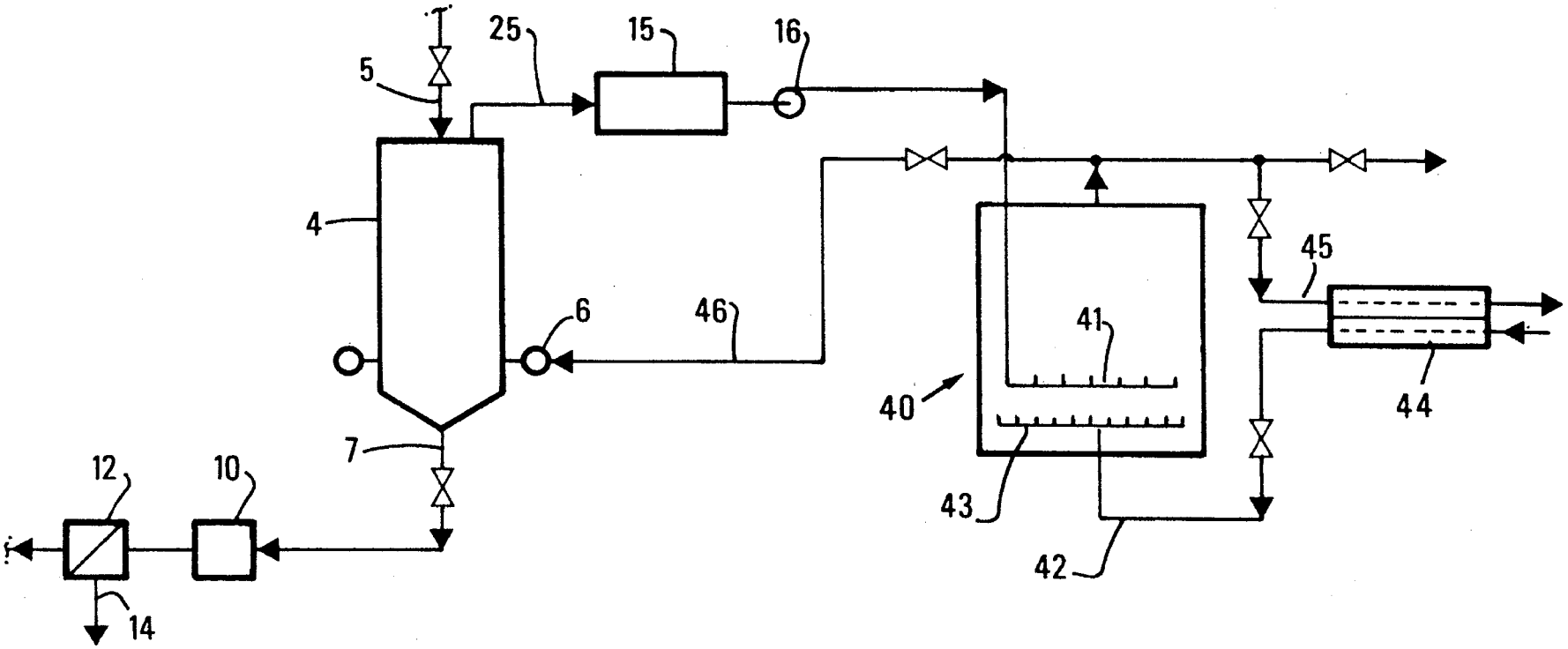
FIG. 2 is a diagram partly showing another embodiment of the invention.

FIG. 2 shows a second embodiment of the invention which only differs from the embodiment described above in the means for burning the gases resulting from the thermolysis.

FIG. 2 only shows the modified part of the plant, and only this part and the working thereof will be described in detail hereafter.

According to this embodiment of the invention, a fluidized bed 40 is used for burning the thermolysis gases.

Using a fluidized bed will be chosen in certain cases, notably when the calorific power of the thermolysis gases is low or variable in time.

In fact, a certain waste has a very heterogeneous nature, which leads to considerable fluctuations in the calorific power of the thermolysis gas. The combustion of such a product by means of burners leads to flame stability problems.

The fluidized bed, with the high thermal inertia thereof, allows the combustion to be stable even when the calorific power of the gases to be burned decreases substantially.

As in the embodiment described above, the thermolysis gases, once reheated in means 15 and set in motion in means 16, are then sent towards fluidized bed reactor 40.

In reactor 40, the thermolysis gases are distributed by a device 41 while the combustion air is introduced through a line 42 preferably located below reactor 40. Any means 43 known in itself may be used for distributing the combustion air.

The combustion air will be preferably preheated for example by means of a gas-gas exchanger 44 in which part of the warm gases extracted from reactor 40 via a line 45 also circulates.

The amount of combustion air introduced in reactor 40 is adjusted so as to permanently keep a low oxygen content for the thermolysis gases. In fact, part of the fumes produced by reactor 40 is sent via a line 46 towards reactor 4 intended for the thermolysis of the waste (the other part being used for preheating the combustion air as has already been stated).

Controlling the oxygen content of the thermolysis gases is in fact very important for the efficient working of the process according to the invention. This control may be achieved by means of a control loop (not shown in FIG. 2).

Fluidized bed 40 is run at a temperature ranging between 700° and 1300° C., preferably between 800° and 1000° C.

As it has been stated above, reactor 40 can work with gases having low calorific powers, less than 1500 $KJ/Nm^3$.

Besides, when fluidized bed 40 totally or partly consists of calcic agents such as lime or limestones, the traces of hydrochloric acid, of hydrofluoric acid or of sulfates, which have not been collected in thermolysis reactor 4, may be easily trapped at the level of reactor 40 by these calcic substances.

Another case may arise when the waste to be treated exhibits a very high degree of moisture.

It is possible, in this case, to place two heat exchangers "in series" at the outlet of warm gas generator 19.

Figure 3:
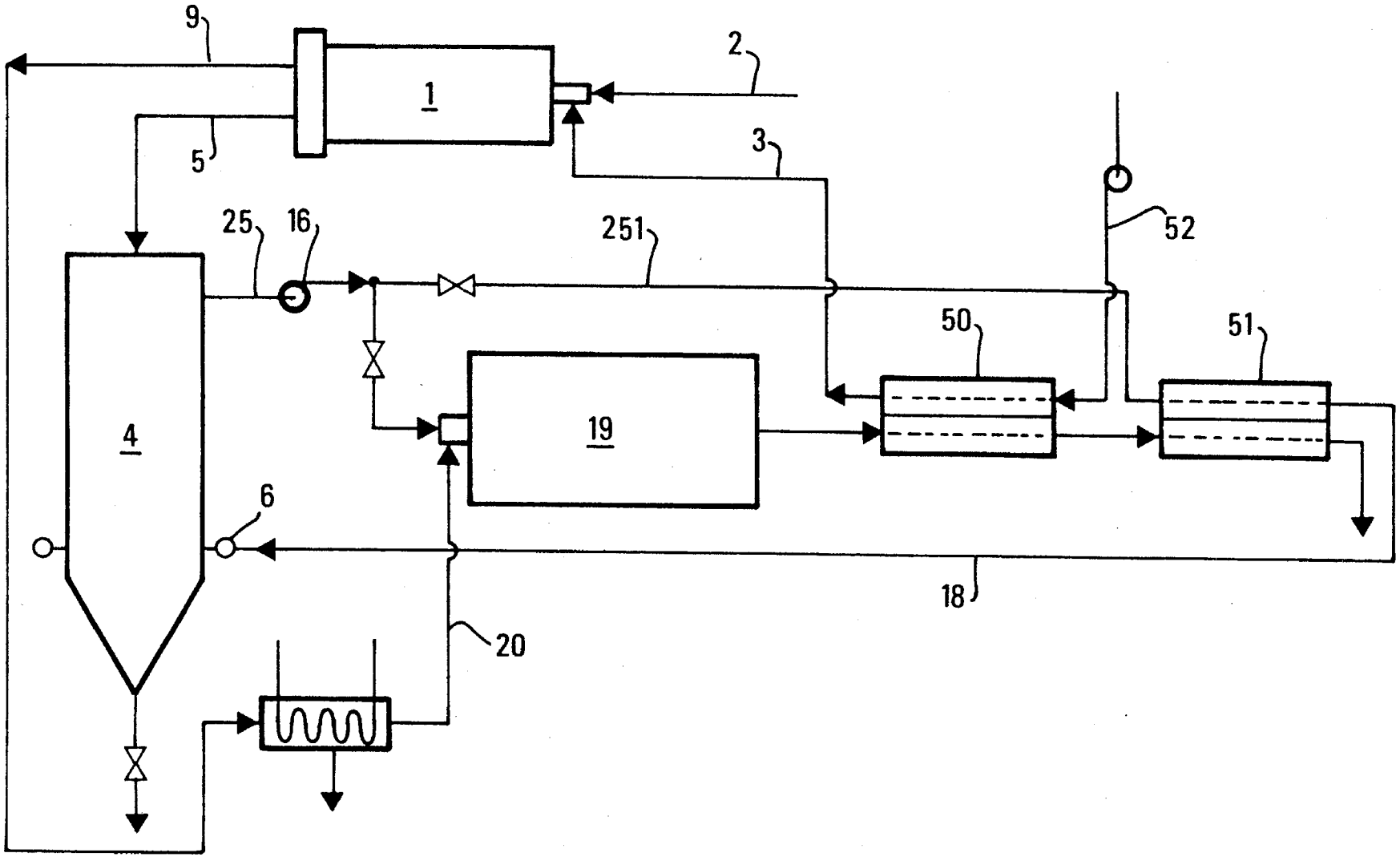
FIG. 3 is a schematic plate showing a third embodiment of the invention.

FIG. 3 shows an example of a plant that can be envisaged in this case. The elements common to the embodiments which have already been described keep the same references as in the previous figures and will not be described again. Only the elements proper to this embodiment will be defined hereafter.

The warm gas generator which is used is preferably a flame incinerator such as that described in the first embodiment of the invention.

At the outlet of generator 19, the warm gases pass into a first exchanger 50 where they are in contact with the air intended for drying.

A pipe 52 is used for introducing the outer air into exchanger 50. Pipe 3 leads the air heated in exchanger 50 up to drier 1.

At the outlet of exchanger 50, the warm gases enter a second gas-gas exchanger 51 where they are used for reheating the part of the thermolysis gases to be recycled. Of course, appropriate pipes (251 and 18) are provided for constituting this recycling circuit which resembles that which has already been defined for the first embodiment of the invention.

The plant shown in FIG. 3 is an embodiment of the invention given by way of non limitative example, which the man skilled in the art may bring changes to without departing from the scope of the invention.

We claim:

1. A process for treating industrial and/or urban waste, comprising the following steps:

drying said waste in a drier;

effecting thermolysis of the dried waste by direct contact with warm gases in a reactor to produce solids and gaseous effluents;

washing the solids resulting from said thermolysis with water to effect dechlorination of the solids;

combusting part of the gaseous effluents resulting from the thermolysis in a gas generator means for generating warm gases; and heating and then recycling part of the gaseous effluents resulting from said thermolysis to said reactor; wherein thermolysis is effected by counter-current flow between the waste and the warm gases in direct contact in said reactor, at least a part of the warm gases in the reactor comprising the gaseous effluents recycled to the reactor; a part of the gaseous effluents issuing from the reactor is introduced into the gas generator means as fuel for generating warm gases; and at least a part of the warm gases generated by and discharged from the gas generator means is used for drying said waste in the drier.

2. A process according to claim 1, wherein the oxygen content of the warm gases used for effecting the thermolysis is lower than 10% by volume.

3. A process according to claim 1, wherein the oxygen content of the warm gases used for effecting the thermolysis is lower than 4% by volume.

4. A process according to claim 1, wherein the warm gases for effecting thermolysis of the waste consist essentially of effluents resulting from fluidized bed combustion, wherein the oxygen content of the warm gases is controlled in said gas generator means.

5. A process according to claim 1, wherein the effluent gases resulting from the thermolysis flow through a heat exchanger to be heated before being recycled to the reactor; said effluent gases being heated in the heat exchanger by indirect contact with another part of the warm gases generated by and discharged from the gas generator means.

6. A process according to claim 1, wherein drying of said waste is effected by warm gases that are discharged from the gas generator means in the drier wherein the warm gases and the waste are passed cocurrently through the drier.

7. A process according to claim 6, which further comprises condensing water vapors in the gases resulting from drying said waste in said drier, collecting the water condensate and using said water condensate as the water for washing of the solids resulting from said thermolysis.

8. A plant for treating industrial and/or urban waste, which comprises:

drier means for drying said waste;

reactor means for thermolyzing said waste to produce solids and gaseous effluents;

means for washing the solids resulting from said thermolysis in said reactor with water to effect dechlorination of the solids;

gas generator means for generating warm gases; and means for supplying a part of the gaseous effluents resulting from chermolysis in said reactor means as a fuel to said gas generator means; means for heating a part of the gaseous effluents from said reactor means and conduit means for recycling said heated gaseous effluents to the reactor means; wherein the reactor means comprises at least one inlet for waste; at least one inlet for warm gases comprising the heated gaseous effluents and at least one outlet for the gaseous effluents produced during thermolysis within said reactor means so that the waste and warm gases within the reactor means are placed in direct contact and are in counter-current flow with each other; and means for supplying said drier means partly with the warm gases generated by said gas generator means.

9. A plant according to claim 8, wherein the gas generator means for generating the warm gases comprises a fluidized bed reactor.

10. A plant according to claim 8 or claim 9, further comprising at least one heat exchanger means for preheating the recycled part of the effluent gases from said reactor means.

11. A plant according to claim 8, further comprising means for condensing water vapors received from said drier means and means for introducing the water condensate to the means for washing the solids.

12. A plant for treating industrial and/or urban waste, which comprises:

drier means for drying said waste;

reactor means for thermolyzing said waste to produce solids and gaseous effluents;

means for washing the solids resulting from said thermolysis in said reactor with water to effect dechlorination of the solids;

gas generator means for generating warm gases, said gas generator means for generating warm gases comprising a fluidized bed reactor;

means for supplying a part of the effluents resulting from thermolysis in said reactor means as a fuel to said gas generator means;

means for heating another part of the gaseous effluents from said reactor means and conduit means for recycling the heated gaseous effluents to the reactor means, conduit means for supplying a part of the warm gases generated by said gas generator means to said reactor means; wherein the reactor means comprises at least one inlet for waste, at least one inlet for warm gases comprising the heated gaseous effluents and the warm gases supplied from the gas generator means, and at least one outlet for discharging the gaseous effluents from said reactor means so that the waste and warm gases in the reactor means are placed in direct contact and are in countercurrent flow with each other; and means for supplying said drier means partly with the warm gases generated by said gas generator means.

* * * * *